US008770920B2

(12) United States Patent
Naik et al.

(10) Patent No.: US 8,770,920 B2
(45) Date of Patent: Jul. 8, 2014

(54) GAS TURBINE AIRFOIL WITH SHAPED TRAILING EDGE COOLANT EJECTION HOLES

(71) Applicant: Alstom Technology Ltd, Baden (CH)

(72) Inventors: Shailendra Naik, Gebenstorf (CH); Martin Schnieder, Ennetbaden (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/622,055

(22) Filed: Sep. 18, 2012

(65) Prior Publication Data

US 2013/0017064 A1 Jan. 17, 2013

Related U.S. Application Data

(63) Continuation of application No. PCT/EP2011/053831, filed on Mar. 15, 2011.

(60) Provisional application No. 61/315,470, filed on Mar. 19, 2010.

(51) Int. Cl.
*F01D 5/18* (2006.01)

(52) U.S. Cl.
CPC ..... *F01D 5/187* (2013.01); *F05D 2240/122* (2013.01); *F05D 2240/304* (2013.01)
USPC ..... 415/115; 416/97 R

(58) Field of Classification Search
USPC ..... 416/96 R, 97 R, 97 A; 415/115, 116
See application file for complete search history.

(56) References Cited

U.S. PATENT DOCUMENTS

| | | | | |
|---|---|---|---|---|
| 4,026,659 | A | 5/1977 | Freeman | |
| 6,508,620 | B2 * | 1/2003 | Sreekanth et al. | 415/115 |
| 6,609,891 | B2 * | 8/2003 | Leeke et al. | 416/97 R |
| 2008/0279696 | A1 | 11/2008 | Liang | |
| 2010/0074763 | A1 * | 3/2010 | Liang | 416/97 R |

FOREIGN PATENT DOCUMENTS

| | | | |
|---|---|---|---|
| EP | 1245786 | A1 | 10/2002 |
| EP | 1749972 | A1 | 2/2007 |
| EP | 2095894 | A1 | 9/2009 |

OTHER PUBLICATIONS

European Patent Office, International Search Report in International Patent Application No. PCT/EP2011/053831 (Apr. 11, 2011).

* cited by examiner

*Primary Examiner* — Edward Look
*Assistant Examiner* — Maxime Adjagbe
(74) *Attorney, Agent, or Firm* — Buchanan Ingersoll & Rooney P.C.

(57) ABSTRACT

A turbine blade or vane includes at least one internal radial channel for the circulation of cooling medium bordered on a pressure side by a pressure side wall and on a suction side by a suction side wall joined at a upstream side at a leading edge and at and downstream side at the trailing edge. At least one exit hole extends through at least one of the pressure side wall or the suction side wall for blowing out of cooling medium from the internal radial channel to a medium surrounding the blade or vane. At least one trailing edge exit hole along the trailing edge has a surfacial exit opening disposed at the pressure side of the trailing edge.

17 Claims, 4 Drawing Sheets a)

b)

GAS TURBINE AIRFOIL WITH SHAPED TRAILING EDGE COOLANT EJECTION HOLES

CROSS REFERENCE TO RELATED APPLICATIONS

This application claims priority to International Patent Application No. PCT/EP2011/053831, filed Mar. 15, 2011, and U.S. Provisional Patent Application No. 61/315,470, filed Mar. 19, 2010, which are hereby incorporated by reference herein in their entirety.

FIELD

The present invention relates to turbine airfoils, i.e. to rotating blades or vanes, in particular for heavy-duty industrial gas turbines and cooling methods therefore, as well as to turbines equipped with such airfoils.

BACKGROUND

In the field of heavy duty industrial gas turbine engines it is important to ensure that the component exposed to the hot gas flow, in particular downstream of the combustion chamber, is at a temperature level which does not harm the corresponding components. Therefore rotating or stationary gas turbine airfoils, typically made of or at least based on metal, have to be cooled internally. To this end they comprise cooling channels provided in the air foils which are supplied with cooling air typically discharged from the compressor end exit. On the one hand cooling is effected by circulation of this cooling air in these internals channels, on the other hand by bores provided in the wall structure of the air foil leading to a blowing-out of the cooling medium and a film cooling at the location of the exits of the cooling hole and downstream thereof.

In particular the air foil trailing edge is required to be maintained at a low metal temperature.

SUMMARY

In an embodiment, the present invention provides a turbine blade or vane including at least one internal radial channel for the circulation of cooling medium bordered on a pressure side by a pressure side wall and on a suction side by a suction side wall joined at a upstream side at a leading edge and at and downstream side at the trailing edge. At least one exit hole extends through at least one of the pressure side wall or the suction side wall for blowing out of cooling medium from the internal radial channel to a medium surrounding the blade or vane. At least one trailing edge exit hole along the trailing edge has a surfacial exit opening disposed at the pressure side of the trailing edge.

BRIEF DESCRIPTION OF THE DRAWINGS

Exemplary embodiments of the present invention are described in the following with reference to the drawings, in which.

DETAILED DESCRIPTION

Figure 1:
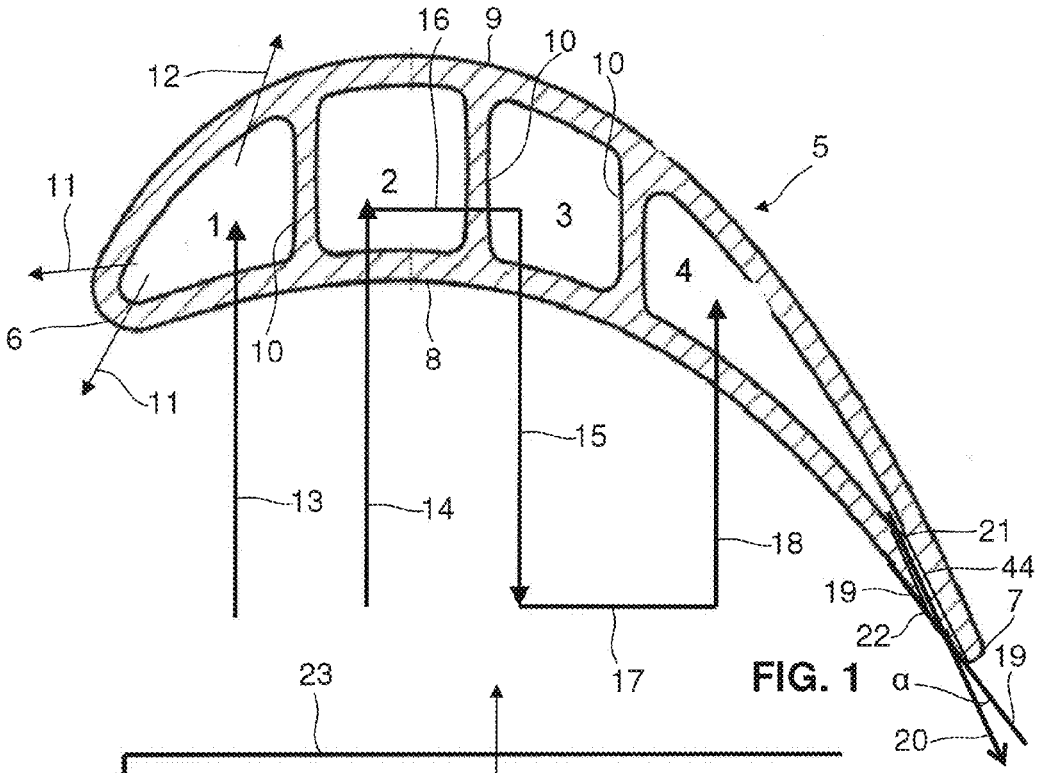
FIG. 1 shows a schematic cut perpendicular to the radial axis of a rotating blade of an industrial gas turbine with cooling channels, including a schematic indication of the cooling air flow along a radial direction.

In an embodiment, the present invention provides an improved cooling scheme for rotating airfoils or stationary airfoils of heavy-duty industrial gas turbines in particular. In particular an improved scheme for film cooling in the trailing edge region of such airfoils shall be provided.

Specifically, the proposed turbine blade or vane comprises at least one internal radial channel, typically if there are several, these are separated from each other by radially extending separation walls, for the circulation of cooling medium. These cooling medium channels are bordered on a pressure side of the airfoil by a pressure side wall and on a suction side of the airfoil by a suction side wall, respectively joined at an upstream side at a radially extending leading edge of the blade/vane and at a downstream side at a radially extending trailing edge of the blade/vane, wherein the turbine blade or vane typically comprises at least one exit hole (so-called film cooling holes) through at least one of pressure side wall or suction side wall or the tip of the blade for the blowing out of cooling medium from the internal channel to the medium surrounding the blade or vane, i.e. to the surrounding hot gas machine airflow.

In accordance with an embodiment of the present invention, this structure is characterised in that along the trailing edge there is at least one trailing edge exit hole the surfacial exit opening of which is located at the pressure side of the trailing edge.

According to a preferred embodiment of the turbine blade or vane the trailing edge exit hole blows out cooling air to the medium surrounding the blade or vane under an angle $\alpha$ with respect to the pressure side wall surface at the blowing-out point, which preferably is in the range of 5-45°, more preferably in the range of 5-30°. In other words the cooling airflow takes place not parallel to the hot gas stream but is somewhat directed into the hot gas stream at the point of exit of the hole.

According to yet another preferred embodiment, the trailing edge side of the surfacial exit opening of the trailing edge exit hole is located close to the trailing edge. This means that it is preferably located not more than 50 mm, more preferably not more than 30 mm, most preferably not more than 10 mm upstream of the trailing edge along the pressure side wall surface. It is however normally not located at the trailing edge so the exit opening it is not along the line of the trailing edge or touching the line of the trailing edge.

According to another preferred embodiment, along the trailing edge and along a radial direction at least two, preferably at least four, trailing edge exit holes are located supplied via individual cooling medium bores connecting the trailing edge exit holes to the internal radial channel. Typically the holes are distributed equally along the trailing edge the distance being the pitch of the row of holes. This pitch, expressed as the ratio of the distance P of the centres of adjacent holes to the diameter d of the holes along the edge is typically in the range of P/d=2-8 for a typical blade in the field of heavy duty industrial gas turbines.

Preferably and according to yet another preferred embodiment, at least one of the bores and/or trailing edge exit holes is inclined with respect to an axial direction of the machine. This can be with a positive or negative angle β which is preferably in the range of 0-50°, more preferably in the range of 10-40°. Preferentially all the bores and/or trailing edge exit holes are inclined with the same angle, preferably with a positive angle β being defined as radially outwards in a downstream direction.

Preferentially the trailing edge exit hole comprises a bore connecting the internal radial channel with the medium surrounding the blade or vane so basically penetrating the wall structure of the blade, and the bore comprises, on its side connecting to the internal radial channel, a circular cylindrical section, and on its side to the surface of the blade or vane a widening section conically widening towards the surface of the blade or vane, wherein preferably the ratio of the length of the circular cylindrical section to the total length of the circular cylindrical section and the widening section is in the range of 0.2-0.7, preferably in the range of 0.2-0.5.

The widening can be in a fully circular manner, i.e. in the sense that the diameter of the circular cross section is gradually increasing towards the surfacial exit hole. On the other hand, and this is preferred, the conical widening can be such that in a direction perpendicular to the plane of the surface of the pressure side wall, the diameter stays constant, while it increases in a direction parallel to the plane of the surface of the pressure side wall. Like that the cross-section becomes increasingly oval or racetrack shaped with an increasing ratio of the long axis to the short axis along and towards the exit of the hole. This fan like widening leads to a particularly good and efficient spreading of the cooling air over the surface of the blade.

Yet another preferred embodiment is characterised in that the trailing edge exit hole comprises a bore connecting the internal radial channel with the medium surrounding the blade or vane, and in that the ratio of the length L of the bore to the diameter d of the bore is in the range of L/d=5-50, preferably in the range of L/d=20-40.

Such a blade typically comprises at least one radial leading-edge cooling passage located closest to the leading edge, at least one intermediate cooling passage as well as at least one trailing edge cooling passage located closest to the trailing edge, and the trailing edge exit hole is supplied by the trailing edge cooling passage, which preferably itself is supplied by cooling medium flow in a radially outward direction by a meander or serpentine type cooling medium circulation within the blade through the further cooling passages.

Preferentially, and according to another preferred embodiment of the invention, at the trailing edge the pressure sidewall of the blade/vane comprises a step recessed towards the suction side. This step can be a casted slot. In this case, at least one trailing edge exit hole can for example at least partly open towards the surrounding medium in the region of this step, wherein preferably at least part of, preferably at least the totality of the surfacial opening of the trailing edge exit hole is located in a radially extending leading-edge surface of the step. This leading-edge surface of the step is particularly preferably at an angle in the range of 60-120°, more preferably in the range of 75-105° with respect to a radially extending bottom surface of the step, wherein most preferably the leading-edge surface is oriented essentially perpendicularly to the hot gas flow on the pressure side and the bottom surface essentially parallel to the hot gas flow on the pressure side.

The trailing edge exit hole can be supplied by cooling medium via a bore which fully opens in a radially extending leading-edge surface of the step and which is distanced from the bottom surface of the step, expressed as a function of the length T of the step along the gas flow direction and the diameter d of the bore, and as a function of the depth t of the step essentially perpendicularly to the gas flow direction and the diameter d of the bore in the range of T/d=8-12, preferably T/d=9-11 or around T/d=10, and in the range of t/d=1.0-1.8 preferably t/d=1.3-1.7, or around t/d=1.5.

The cross-section of the bore, in particular at the point of exit, be it in such a step or just on the pressure side of the blade/vane, can be circular, oval, elliptical or racetrack shaped, preferably in the latter cases with the long axis aligned along a radial direction.

The trailing edge exit hole can, in the alternative, be supplied by cooling medium via a bore which only partly opens in a radially extending leading-edge surface of the step and which at least partly, preferably over the full length, channels through the bottom surface of the step forming scarfed holes.

Typically such a blade/vane is at least partly based on metal and/or ceramics, coated or uncoated, and it is a rotating or stationary turbine aerofoil.

Furthermore the present invention pertains to a turbine, preferably a gas turbine with a turbine blade as outlined and defined above.

As pointed out above, in an embodiment, the present invention provides a design of film cooling holes which are aligned with the pressure side of the trailing edge, and which can significantly reduce the metal temperatures of the airfoil, thereby extending the component lifetime. In the following several different concepts to implement this general scheme will be shown and discussed.

FIG. 1 shows a gas turbine blade 5 with a number of flow passages, specifically a leading edge cooling passage 1 located closest to the leading edge 6 of the blade, two intermediate cooling passages 2, 3 located in the middle portion of the blade, and a trailing edge cooling passage 4 located at the trailing edge of the blade 5. So basically the blade 5 is a hollow structure with two walls, one side wall on the pressure side 8 and one side wall on the suction side 9, which extend radially and are connected by a rounded portion forming the leading edge 6 and by a tip like portion at the downstream end of the blade forming the trailing edge 7.

Within this hollow profile there are located separating walls 10, extending radially between the foot of the blade and the tip of the blade, separating the above-mentioned individual cooling passages from each other. Typically the separating walls 10 extend between the two side walls on the pressure side 8 and the suction side 9, respectively, and can either be, as illustrated in FIG. 1, arranged essentially parallel to each other and essentially orthogonal to the surface of the pressure side 8 in a central portion of the blade, they can however also be inclined with respect to each other at various angles. There can also be provided passages between individual channels for exchange of cooling medium between the cooling passages.

As illustrated schematically in FIG. 1, a typical cooling medium flow in these channels 1-4 is given in that cooling air flow is introduced into the foot of the blade and into the leading edge cooling passage 1 and then travels, as illustrated by arrow 13, radially outwards to the tip of the foil, and as travelling along exits through film cooling holes 11 which are located near or at the leading edge 6 of the blade or at the suction side 12, or also via film cooling holes located at the very tip of the blade.

A second cooling airflow is fed into channel 2, the more leading edge oriented of the two intermediate cooling passages, at the foot of the blade and also travels radially outwards through channel 2 as illustrated schematically by arrow 14. In this case, as there are no film cooling holes, in the tip portion of the blade 5 there is a passage between the intermediate cooling passage 2 and the intermediate cooling passage 3, so at the tip portion there is one or a series of holes in the separating wall 10 separating these two channels 2, 3, such that the cooling air passes, as illustrated schematically by arrow 16, to the intermediate cooling passage 3 at the trailing edge side and then travels radially inwards towards the axis of the machine as illustrated schematically by arrow 15. At the foot of the blade 5, this cooling airflow stream is again redirected through a hole or a series of holes in the separating walls 10 between channels 3 and 4 and enters the trailing edge cooling passage at the trailing edge side on the foot thereof. It then again travels upwards in a radial direction towards the tip of the blade and cools the walls bordering the trailing edge cooling passage 4 from the interior side, as this is illustrated by arrows 17 and 18.

Correspondingly therefore, the cooling medium follows, in a meander or serpentine type fashion, the arrows 14-18 through the channels 2-4.

According to an embodiment of the present invention, the cooling airflow 18 travelling in the trailing edge cooling passage 4 at least partly exits in the region of the trailing edge 7 via one or a series of trailing edge exit holes 22, so via a trailing edge coolant ejection 21.

In accordance with this embodiment as illustrated in FIG. 1, this trailing edge coolant ejection 21 is realized by a bore 44 connected to channel 4 with the surrounding of the blade 5. This bore 44 is located such that its exit opening 22 is located in the pressure side wall of the blade essentially just upstream of the trailing edge 7.

The bore 44 is thereby arranged at an angle $\alpha$ with respect to the pressure side wall surface plane at the trailing edge, as schematically illustrated by line 19 in FIG. 1. In other words the cooling air exit direction 20 at the trailing edge coolant ejection hole is not parallel to the pressure side wall surface at this point but inclined to it with the angle $\alpha$. Therefore the cooling airflow 20 is not blown into the pressure side hot gas airflow in a parallel manner but it is blown into it under a slant angle leading to an increased film cooling effect.

This pressure side bleed ejection of the coolant flow enables the air foil to operate at a higher inlet hot gas temperature, while maintaining the same (or lower) cooling air consumption relative current operating hot gas temperature.

To summarize in FIG. 1 the airfoil is fed by cooling air discharged from the compressor end exit at the blade root, and the air travelling in cooling passage 1 is discharged via the leading edge cooling air exits 11 and cooling air exits at the suction side 12, and a second cooling airflow 14 flows through the blade in a serpentine manner through the channels 2-4 and is then discharged via the tip (not shown) and, in accordance with the invention, specifically at and along the trailing edge.

Figure 2:
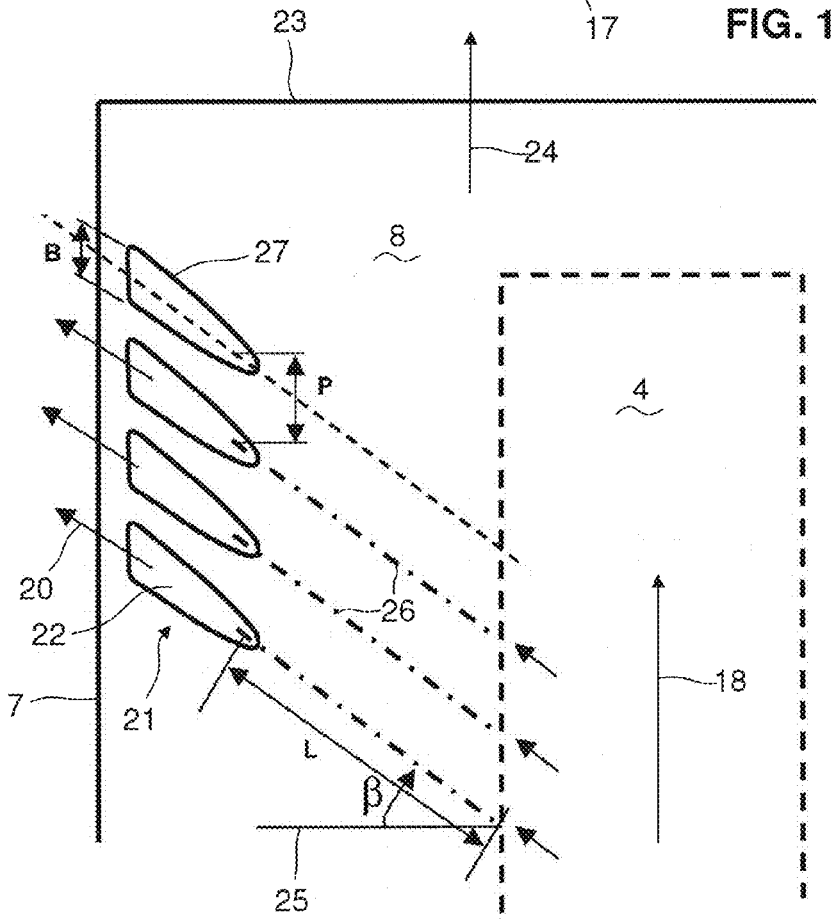
FIG. 2 shows a view onto the pressure side of a rotating blade of an industrial gas turbine, in particular onto the tip/trailing edge region thereof.

In FIG. 2 a side view onto the pressure side 8 of such a blade is shown for a specific embodiment. It shows the trailing edge region near the tip 23 of the blade, and schematically, using a dashed line, the location of the trailing edge cooling passage 4 is illustrated and also the corresponding radially outward cooling airflow 18 flowing therein. As one can see rather long channels provide for a flow of cooling air from this trailing edge cooling passage 4 through the trailing edge wall portion of the blade to the trailing edge exit holes 22, which are arranged as a series of holes distributed equally along the trailing edge 7. Series of individual holes 22 are individually fed by rather narrow bores connecting channel 4 and these trailing edge exits holes 22. The length L of these bores 44 is long with respect to the corresponding diameter d of the bore, and typically the ratio of the length L of the bore to the diameter of the bore d, given as L/d, is in the range of 5-50, and typically around 30.

Furthermore the holes are distanced in a radial direction by a pitch P. In addition to that the channels and also the exit holes 22 are not aligned along the axis but are inclined, in a direction radially downstream outwards as illustrated in FIG. 2, under a positive angle $\beta$ with respect to the axial direction 25, which typically is in the range of 20° to 40°, preferably around 30°. The cooling airflow 20 exiting just upstream of the trailing edge 7 on the pressure side 8 of the blade is therefore directed radially outwards.

Figure 3:
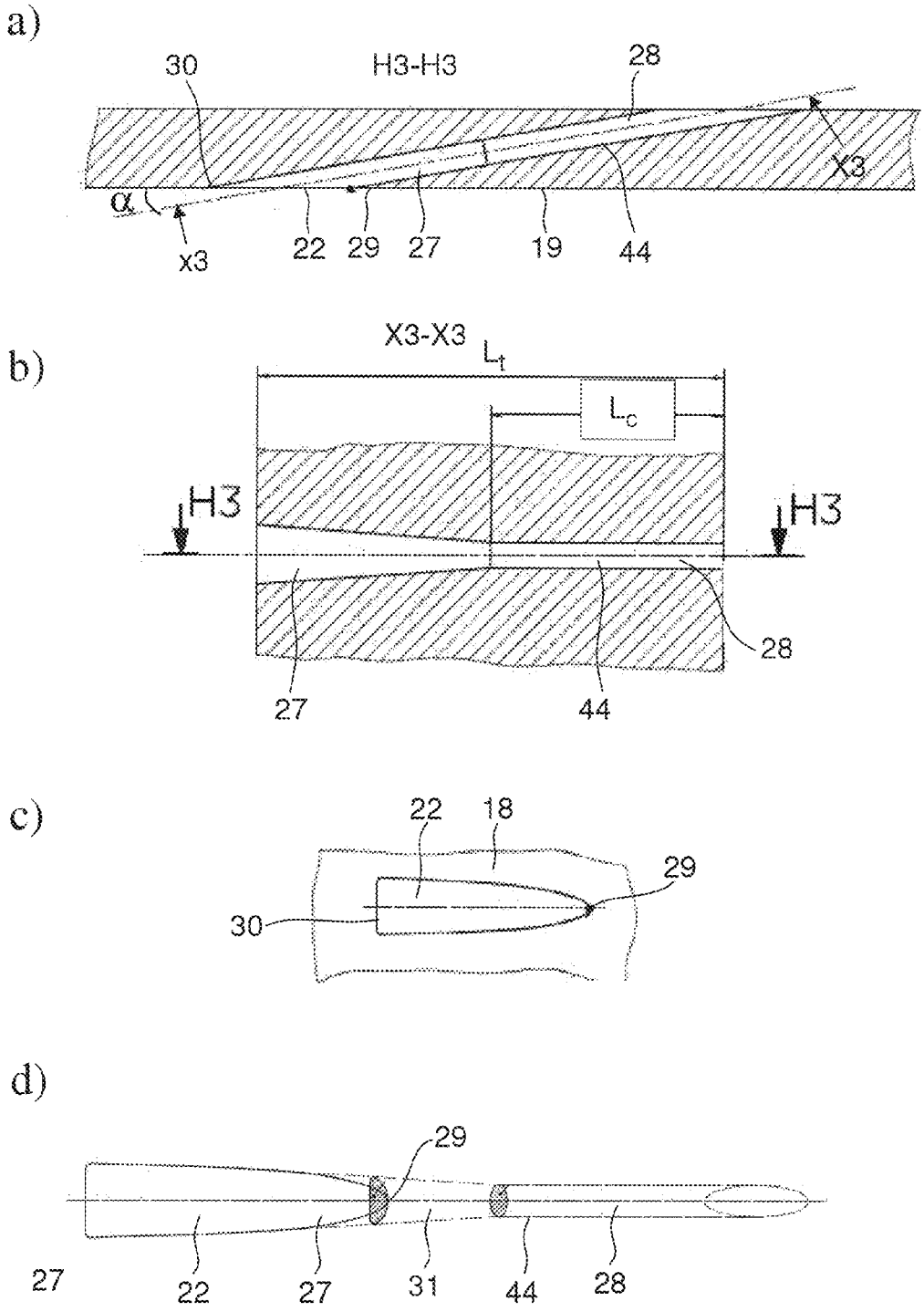
FIG. 3 shows different detailed representations of the trailing edge exit holes, wherein in a) a cut essentially perpendicular to a radial direction of the blade is shown, in b) a cut in a radial plane along the main axis of the trailing edge exit hole is shown, in c) a view onto the surfacial exit opening of the trailing edge exit hole is shown and in d) a schematic view onto a trailing edge exit hole with terminal widening section is shown.

Furthermore the actual exit holes 22 are specifically structured in a widening manner as will be illustrated in more detail by using the illustration of FIG. 3.

As one can see in FIG. 3 the bore 44 defining the trailing edge coolant ejection 21 in this embodiment comprises a circular cylindrical section 28, defined by the above-mentioned diameter d followed at the exit side by a radially widening section 27, where the diameter is gradually increasing. The main axis of the bore is, as illustrated in FIG. 3*a*, and as mentioned above, inclined with respect to the surface plane 19 at the pressure side wall under an angle $\alpha$.

The widening can be realized, as this is specifically illustrated in Figures a and b, by only widening in a direction essentially radial with respect to the machine, so the widening is only visible in the illustration b), while in the illustration a) there is no widening within the section 27. However there can also be widening, in the sense of a full tubular widening along both directions.

The widening as illustrated in FIG. 3, which only widens in a direction parallel to the plane of the blade, then leads to the particular structure as illustrated in FIG. 3*d*, so to a fan like widening of the final hole 22 and to a particularly efficient distribution over the surface of the pressure side blade wall. It is thereby preferred to stick to a certain ratio of the length of the total bore 44 to the cylindrical section 28, this ratio, being defined as Lt–Lc, is in the range of 0.2-0.7, preferably around 0.5.

Figure 4:
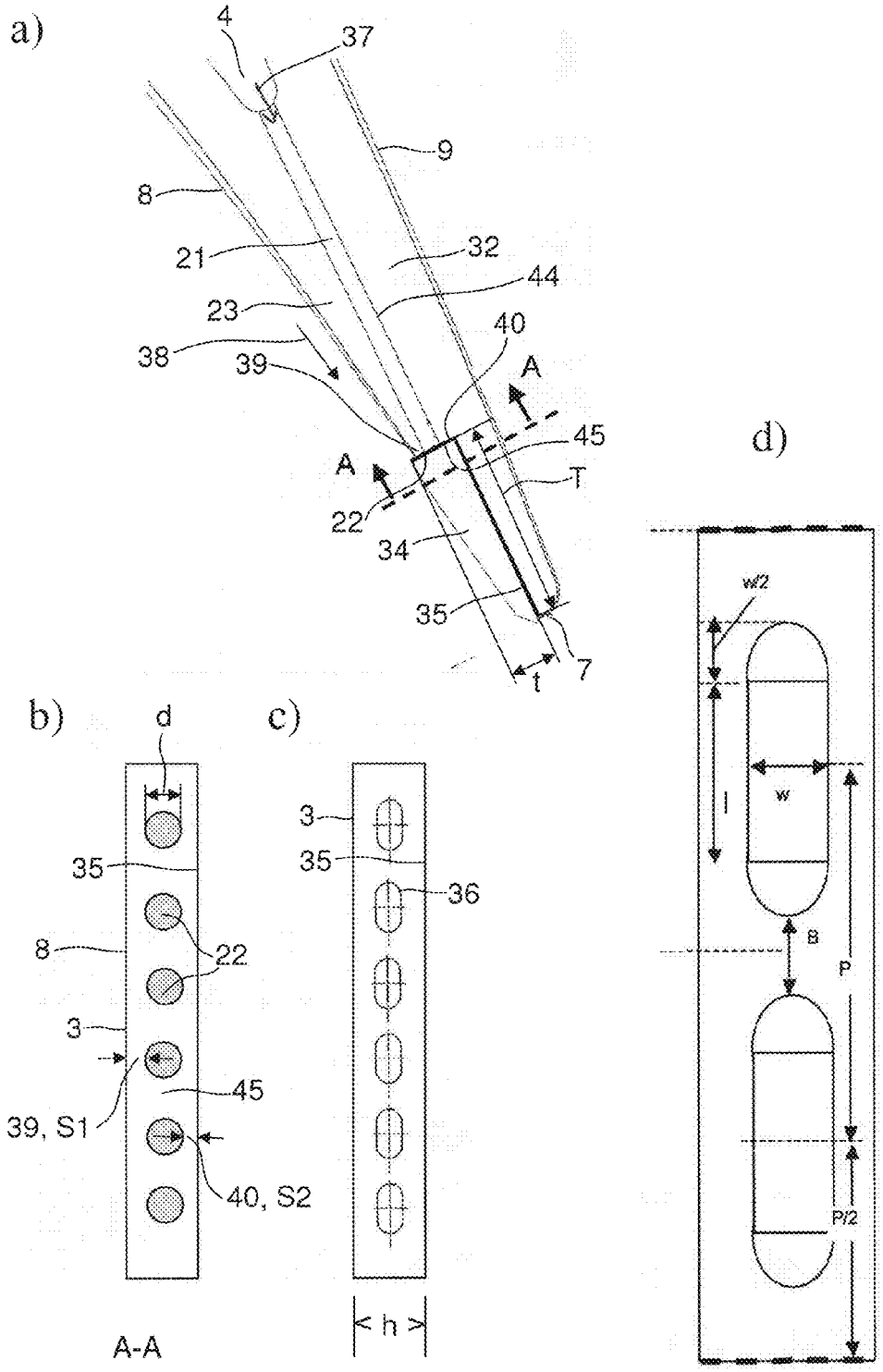
FIG. 4 shows different views and representations of rotating blades with a trailing edge step, wherein the exit openings open completely into the leading-edge facing side surface of the step, wherein in a) a schematic cut along a plane perpendicular to the radial direction of the blade is shown in the trailing edge region, in b) a view onto the leading-edge facing side surface of the step is shown for cylindrical bores and in c) for race track bores, and in d) the details of c) are shown.

A different embodiment of the invention is shown in FIG. 4. Here the trailing edge cooling airflow is realized by providing a step 34 in the pressure side wall at the trailing edge 7. According to a first embodiment as illustrated in FIG. 4, this step 34 is defined by a leading edge side surface 45 which defines the cut-out of the step 34 and which is arranged essentially perpendicularly to the hot gas flow 38 on the pressure side 8 and which surface 45 extends radially either along the full length of the trailing edge or over sections thereof. The depth of this step perpendicularly to the hot gas flow 38 on the pressure side 8 is designated with t, its length essentially parallel to or along the hot gas flow 38 on the pressure side 8 is designated with T.

On the other hand, and arranged essentially perpendicularly to this surface 45, there is the bottom surface 35 of the step 34, which is arranged essentially parallel to the chord line of the blade and which, in this case, approximately half the full width of the blade in this very terminal section at the trailing edge 7.

According to this embodiment, the bore 44 of the trailing edge coolant ejection 21 terminates in the above-mentioned leading edge side surface 45 and thus enters the step 34. As illustrated in FIG. 4*b*, the bores 44, if having a circular cross section, are given as a series of circular holes distributed along the radial direction, with a small distance 39, typically in the range of, expressed as the ratio of the distance S1 from the pressure side wall 8 (reference numeral 39) to the diameter d, so S1/d=1.0-1.8, preferably 1.5, and as a function of the small distance S2 (reference numeral 40) in the range of S2/d=0.1-0.3, preferably 0.15 with respect to the bottom surface 35.

In the alternative, and as illustrated in FIG. 4, this series of holes can also be given as a series of racetrack holes, the long axis of which is aligned along the radial direction. Typically the height h of the step 34 is, as a function of the width w, in the range of h=2w-3w. Indeed the dimensions of these racetrack holes are typically detailed as given in FIG. 4*d*, wherein w is generally the same as d, 1 in the range of l=0.5w-1.5w, P is in the range of P=2w-5w, preferably P=3.5w.

Figure 5:
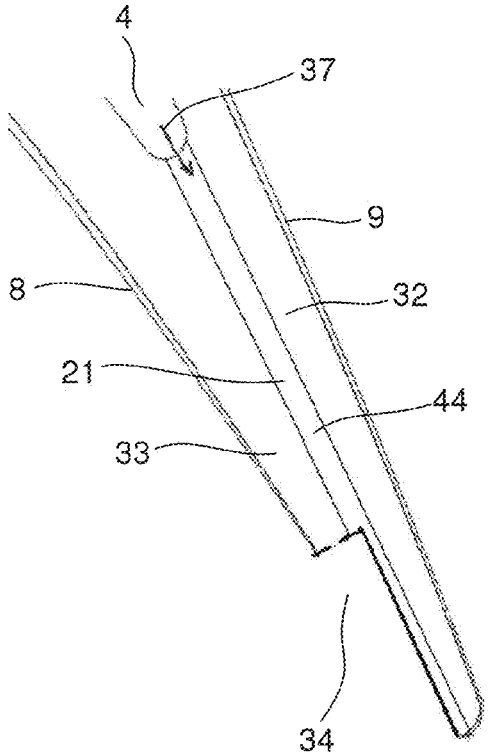
FIG. 5 shows different views and representations of rotating blades with a trailing edge step, wherein the exit openings partly open into the leading-edge facing side surface of the step and form scarfed holes, wherein in a) a schematic cut along a plane perpendicular to the radial direction of the blade is shown in the trailing edge region, and in b) a perspective view onto the step is shown.
Figure 5:
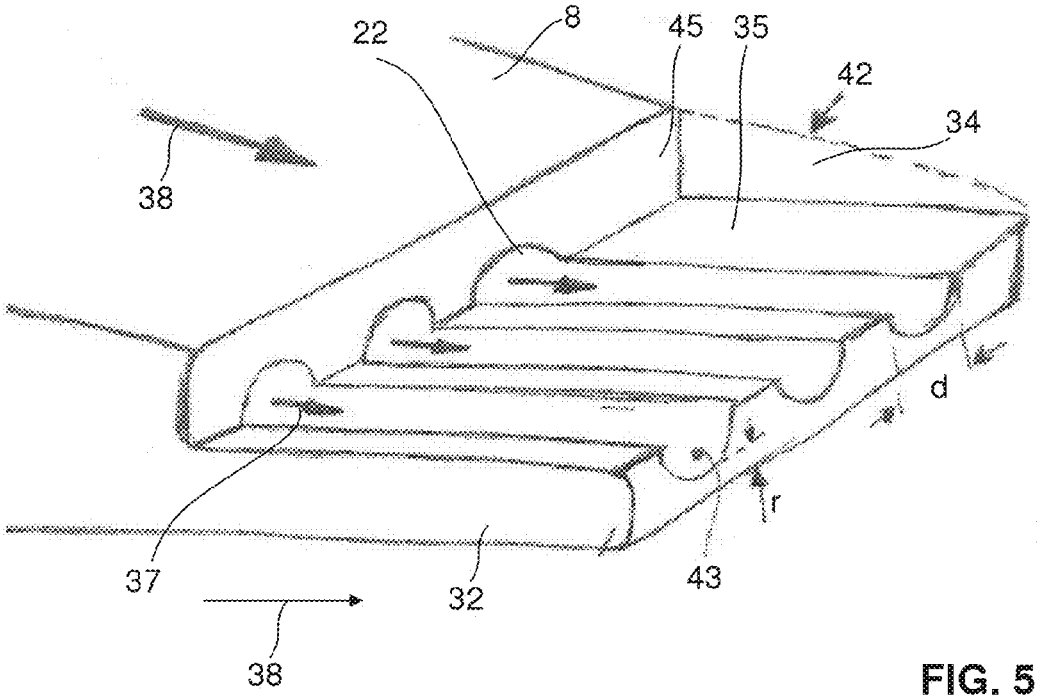

Yet another embodiment with such a step 34 is illustrated in FIG. 5. Here the bore 44 of the series of cooling air exit holes does not terminate in the surface 45 of the step 34, but only approximately half of the cross section. Therefore so to speak the other half of the bore cross-section forms a series of channels in the bottom surface 35 of the step 34, defining so called scarfed holes 43 ending at the trailing edge 7. These grooves 43 typically have a depth such that their bottom distance to the suction side wall, as defined by r, is not less than r=0.5d-0.8d.

While the invention has been particularly shown and described with reference to preferred embodiments thereof, it will be understood by those skilled in the art that various changes in form and details may be made therein without departing from the spirit and scope of the invention.

LIST OF REFERENCE SIGNS

1 leading edge cooling passage
2 intermediate cooling passage at leading-edge side
3 intermediate cooling passage at trailing edge side
4 trailing edge cooling passage
5 turbine blade
6 leading-edge
7 trailing edge
8 pressure size
9 suction side
10 separating walls between cooling passages
11 cooling air exit at leading-edge
12 cooling air exit at suction side
13 cooling airflow from root of blade to tip of blade in 1
14 cooling airflow from root of blade to tip of blade in 2
15 cooling airflow from tip of blade to route of blade in 3
16 cooling airflow in passage in tip section of blade between 2 and 3
17 cooling airflow in passage in root section of blade between 3 and 4
18 cooling airflow from root of blade to tip of blade in 4
19 pressure side wall surface plane at trailing edge
20 cooling air exit direction at trailing edge coolant ejection hole
21 trailing edge coolant ejection
22 trailing edge exit hole of 21 in 19
23 tip of 5
24 radial direction
25 axial direction
26 axis of 21
27 radially widening section of 21
28 circular cylindrical section of 21
29 leading-edge end of 22
30 trailing edge end of 22
31 section of 27 within the blade structure
32 suction side wall of blade
33 pressure side wall of blade
34 step in pressure side wall at trailing edge
35 bottom surface of 34
36 racetrack shaped hole
37 coolant flow in 21
38 hot gas flow on pressure side
39 residual thickness of 33, S1
40 distance at suction side, S2
41 suction side gas flow
42 casted slot
43 scarfed hole
44 bore of 22
45 leading-edge side surface of 34
α angle between 19 and 20
β angle between 25 and 26
B radial width at trailing edge end of 21
P pitch
L length of tubular section of 21
Lt total length of 21
Lc length of circular cylindrical section of 21
B radial distance between 36
w width in circumferential direction of 36
l radial length of 36
h height of 34
t depth of 34
T length of 34
d diameter of 21
r residual thickness of 32
d diameter

What is claimed is:

1. A turbine blade or vane comprising:

at least one internal radial channel for the circulation of cooling medium bordered on a pressure side by a pressure side wall and on a suction side by a suction side wall joined at a upstream side at a leading edge and at and downstream side at the trailing edge;

at least one exit hole through at least one of the pressure side wall or the suction side wall for blowing out of cooling medium from the internal radial channel to a medium surrounding the blade or vane;

at least one trailing edge exit hole along the trailing edge and having a surfacial exit opening disposed at the pressure side of the trailing edge; and at least one radial leading-edge cooling passage disposed in proximity to the leading edge, at least one intermediate cooling passage and at least one trailing edge cooling passage disposed in proximity to the trailing edge, the trailing edge exit hole being supplied by the trailing edge cooling passage;

wherein at the trailing edge, the pressure side wall of the blade or vane includes a step recessed towards the suction side, the at least one trailing edge exit hole being at least partly open towards the surrounding medium in a reqion of the step, and wherein the trailing edge exit hole is supplied by cooling medium via a bore which only partly opens in a radially extending leading-edge surface of the step and which at least partly channels through the bottom surface of the step forming scarfed holes.

2. The turbine blade or vane recited in claim 1, wherein the trailing edge exit hole is configured to blow out cooling air to the medium surrounding the blade or vane under an angle with respect to the pressure side wall surface at a blowout point in a range of 5-45°.

3. The turbine blade or vane recited in claim 1, wherein an angle with respect to the pressure side wall surface is in a range of 5-30°.

4. The turbine blade or vane recited in claim 1, wherein the trailing edge side of the surfacial exit opening of the trailing edge exit hole is not more than 50 mm upstream of the trailing edge along the pressure side wall surface.

5. The turbine blade or vane recited in claim 1, wherein at least two trailing edge exit holes are disposed along the trailing edge and along a radial direction that are supplied via individual cooling medium bores connecting the trailing edge exit holes to the internal radial channel.

6. The turbine blade or vane recited in claim 5, wherein at least one of the cooling medium bores or trailing edge exit holes is inclined with respect to an axial direction of a machine with a positive or negative angle in a range of 0-50°.

7. The turbine blade or vane recited in claim 1, wherein the trailing edge exit hole includes a bore connecting the internal radial channel with the medium surrounding the blade or vane, the bore including, on a side connecting to the internal radial channel, a circular cylindrical section, and on a side to the surface of the blade or vane, a widening section conically widening towards the surface of the blade or vane.

8. The turbine blade or vane recited in claim 7, wherein a ratio of a length of the circular cylindrical section to a total length of the circular cylindrical section and the widening section is in the range of 0.2-0.7.

9. The turbine blade or vane recited in claim 1, wherein the trailing edge exit hole includes a bore connecting the internal radial channel with the medium surrounding the blade or vane, a ratio of the length of the bore to a diameter of the bore being in a range of 5-50.

10. The turbine blade or vane recited in claim 1, wherein at least the totality of the surfacial opening of the trailing edge exit hole is located in a radially extending leading-edge surface of the step.

11. The turbine blade or vane recited in claim 10, wherein surfacial opening of the trailing edge exit hole is disposed at an angle in the range of 60-120° with respect to a radially extending bottom surface of the step.

12. The turbine blade or vane recited in claim 1, wherein the trailing edge exit hole is supplied by cooling medium via a bore with a diameter (d) which fully opens in a radially extending leading-edge surface of the step and which is distanced from the bottom surface of the step by a first distance (S1) in a range of S1/d=1.0-1.8, and distanced from the pressure side wall surface by a second distance (S2) in a range of S2/d=0.1-0.3.

13. The turbine blade or vane recited in claim 5, wherein a cross-section of the bore, in one of the wall structure of the blade or vane or at the surfacial opening line, is circular, oval, elliptical or racetrack shaped.

14. The turbine blade or vane recited in claim 1, wherein the blade or vane is at least partly based on metal.

15. The turbine blade or vane recited in claim 1, wherein the blade or vane is a rotating or stationary turbine aerofoil.

16. A turbine including a turbine blade comprising:

at least one internal radial channel for the circulation of cooling medium bordered on a pressure side by a pressure side wall and on a suction side by a suction side wall joined at a upstream side at a leading edge and at and downstream side at the trailing edge;

at least one exit hole through at least one of the pressure side wall or the suction side wall for blowing out of cooling medium from the internal radial channel to a medium surrounding the blade or vane;

at least one trailing edge exit hole along the trailing edge and having a surfacial exit opening disposed at the pressure side of the trailing edge; and at least one radial leading-edge cooling passage disposed in proximity to the leading edge, at least one intermediate cooling passage and at least one trailing edge cooling passage disposed in proximity to the trailing edge, the trailing edge exit hole being supplied by the trailing edge cooling passage;

wherein at the trailing edge, the pressure side wall of the blade or vane includes a step recessed towards the suction side, the at least one trailing edge exit hole being at least partly open towards the surrounding medium in a region of the step, and wherein the trailing edge exit hole is supplied by cooling medium via a bore which only partly opens in a radially extending leading-edge surface of the step and which at least partly channels through the bottom surface of the step forming scarfed holes.

17. The turbine recited in claim 16, wherein the turbine is a gas turbine.

* * * * *